US011906277B2

(12) United States Patent
Mason et al.

(10) Patent No.: US 11,906,277 B2
(45) Date of Patent: Feb. 20, 2024

(54) FIRING DEVICE FOR SHOCK TUBE

(71) Applicants: Richard Ashley Mason, Little Rock, AR (US); Christopher Waller, North Little Rock, AR (US)

(72) Inventors: Richard Ashley Mason, Little Rock, AR (US); Christopher Waller, North Little Rock, AR (US)

( * ) Notice: Subject to any disclaimer, the term of this patent is extended or adjusted under 35 U.S.C. 154(b) by 0 days.

(21) Appl. No.: 18/117,993

(22) Filed: Mar. 6, 2023

(65) Prior Publication Data

US 2023/0280139 A1 Sep. 7, 2023

Related U.S. Application Data

(60) Provisional application No. 63/316,467, filed on Mar. 4, 2022.

(51) Int. Cl.

| | |
|---|---|
| ***F42D 1/04*** | (2006.01) |
| ***F42B 3/10*** | (2006.01) |
| ***F42C 7/12*** | (2006.01) |
| ***F42C 19/08*** | (2006.01) |
| ***F42C 19/10*** | (2006.01) |
| ***C06C 5/06*** | (2006.01) |
| *F42B 39/30* | (2006.01) |

(52) U.S. Cl.

CPC ..... *F42D 1/043* (2013.01); *C06C 5/06* (2013.01); *F42C 19/0807* (2013.01); *F42B 3/10* (2013.01); *F42B 39/30* (2013.01); *F42C 7/12* (2013.01); *F42C 19/10* (2013.01)

(58) Field of Classification Search

CPC .... F42D 1/04; F42D 1/043; F42C 7/00; F42C 7/12; F42C 19/08; F42C 19/10; F42C 19/0807; C06C 5/06; C06C 5/04; F42B 3/10

See application file for complete search history.

(56) References Cited

U.S. PATENT DOCUMENTS

| | | | | |
|---|---|---|---|---|
| 3,356,025 | A * | 12/1967 | Duncan | F42C 7/12 102/261 |
| 5,012,741 | A * | 5/1991 | Peebles | C06C 5/06 102/275.3 |
| 6,272,996 | B1 | 8/2001 | O'Brien et al. | |
| 6,581,519 | B1 | 6/2003 | Adams | |
| 7,451,700 | B1 * | 11/2008 | Land | F42D 1/04 102/209 |
| 7,490,554 | B2 * | 2/2009 | Lynch | F42C 7/12 102/275.12 |
| 7,650,993 | B2 | 1/2010 | Bawabe | |
| 7,665,401 | B2 * | 2/2010 | Ballantine | C06C 5/04 102/331 |

(Continued)

*Primary Examiner* — James S Bergin

(74) *Attorney, Agent, or Firm* — Asgaard Patent Services, LLC; F. Wayne Thompson, Jr.

(57) ABSTRACT

Disclosed is a firing device for shock tube. Shock tube is a non-electric explosive initiator, well known to those of ordinary skill in the art. The firing device is configured to provide a redundant dual-ignition capability for connected shock tube. In this way, a second attempt to initiate the shock tube can be made immediately following a failed first attempt. To provide this functionality, the firing device includes a primer tray that can be preloaded with two primers. Using an operably connected selector, the primer tray can be rotated between use positions that individually locate each primer for detonation.

17 Claims, 16 Drawing Sheets

(56) References Cited

U.S. PATENT DOCUMENTS

| | | | | |
|---|---|---|---|---|
| 7,765,932 | B2 * | 8/2010 | Allman | C06C 5/06 102/275.6 |
| 9,791,247 | B2 * | 10/2017 | Parker | F42C 7/12 |
| 2007/0266881 | A1 | 11/2007 | Allman | |
| 2008/0276818 | A1 | 11/2008 | Ballantine et al. | |
| 2016/0370157 | A1 | 12/2016 | Parker | |

* cited by examiner

FIRING DEVICE FOR SHOCK TUBE

CROSS-REFERENCE TO RELATED APPLICATION(S)

This application claims the benefit of U.S. Provisional Application Ser. No. 63/316,467, filed on Mar. 4, 2022, the entirety of which is incorporated herein by reference.

TECHNICAL FIELD

This disclosure relates to implementations of a firing device for shock tube.

BACKGROUND

A firing device works in conjunction with a primer, often a 209 primer, for the purpose of generating an explosive shock wave through the shock tube to a detonator, such as a blasting cap. Single and dual firing devices have been used for many years to initiate non-electric shock tube. Most such devices provide a single primer to initiate an attached shock tube. However, primer misfire (e.g., failing to detonate or failing to initiate the shock tube) is a known problem and prior art firing devices are not configured to readily provide a second primer for another attempt at initiating the shock tube.

Accordingly, needs exist for the firing device for shock tube disclosed herein. It is to the provision of a firing device for shock tube configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a firing device for shock tube. Shock tube is a non-electric explosive initiator, well known to those of ordinary skill in the art. The firing device is configured to provide a redundant dual-ignition capability for connected shock tube. In this way, a second attempt to initiate the shock tube can be made immediately following a failed first attempt. To provide this functionality, the firing device includes a primer tray that can be preloaded with two primers. Using an operably connected selector, the primer tray can be rotated between use positions that individually locate each primer for detonation.

An example firing device for shock tube comprises a body having a shock tube adapter on one end, a primer tray configured to hold two primers, and a selector operably connected to the primer tray. The shock tube adapter is configured to connect one end of shock tube to the firing device. The primer tray defines two primer apertures and can be rotated between two use positions. Each use position aligns one of the two primer apertures with an interior tubular aperture extending through the shock tube adapter.

Another example firing device for shock tube comprises a body having a first end and a second end, a shock tube adapter attached to the first end of the body, a primer tray configured to hold two primers, a selector operably connected to the primer tray, and a debris shield removably attached to the first end of the body. The shock tube adapter is configured to connect one end of shock tube to the firing device. The primer tray defines two primer apertures and can be rotated between two use positions. Each use position aligns one of the two primer apertures with an interior tubular aperture extending through the shock tube adapter. The debris shield is configured to enclose the primer tray and a portion of the shock tube adapter.

BRIEF DESCRIPTION OF THE DRAWINGS

Like reference numerals refer to corresponding parts throughout the several views of the drawings.

DETAILED DESCRIPTION

Figure 16:
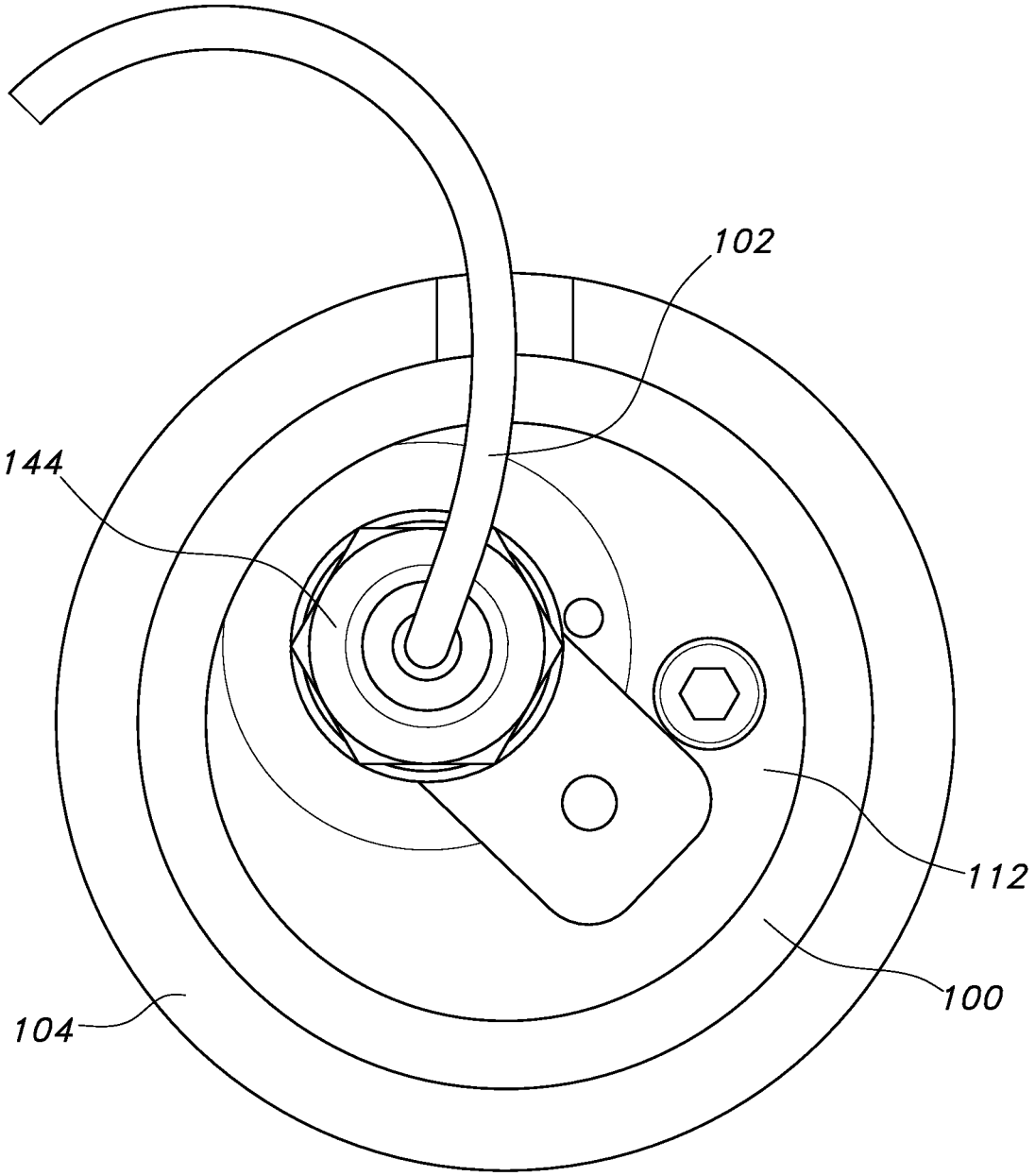
FIG. 16 is a top plan view of the firing device for shock tube shown in FIG. 15, wherein an end of the shock tube is shown attached to the nozzle of the shock tube adapter by an instant fit connector.

FIGS. 1-5 illustrate an example firing device 100 for shock tube according to the principles of the present disclosure. Shock tube 102 is a non-electric explosive initiator, well known to those of ordinary skill in the art. The firing device 100 is configured to provide a redundant dual-ignition capability for connected shock tube 102 (see, e.g., FIG. 16). In this way, a second attempt to initiate the shock tube 102 can be made immediately following a failed first attempt. More specifically, the firing device 100 includes a primer tray 114 that can be preloaded with two primers (e.g., 209 primers). Using an operably connected selector 116, the primer tray 114 can be rotated between use positions that individually locate each primer for detonation.

A center punch 108, well known to those of ordinary skill in the art, is used to individually detonate primers carried by the firing device 100. An example center punch 108 comprises a handle 108*a* and a spring-loaded punch 108*b* having a pointed tip. However, it should be understood that a center punch, or "window breaker", comprising a handle and a fixed punch having a pointed tip could also be used. The center punch 108 is not an element of the invention.

As shown best in FIGS. 1-9, the firing device 100 comprises a body 110 having a shock tube adapter 112 on one end, a primer tray 114 configured to hold two primers, a selector 116 operably connected to the primer tray 114, and a removable debris sleeve 118. The shock tube adapter 112 is configured to connect one end of shock tube 102 to the firing device 100. The primer tray 114 includes two primer apertures 120 and can be rotated between two use positions, each of which aligns one of the primer apertures 120 with an interior tubular aperture 122 (also referred to as a "flash channel") extending through the shock tube adapter 112. In this way, a flame jet caused by detonation of a primer can travel through the primer aperture 120, through the interior tubular aperture 122, to the connected shock tube 102, thereby initiating the shock tube 102.

Figure 13:
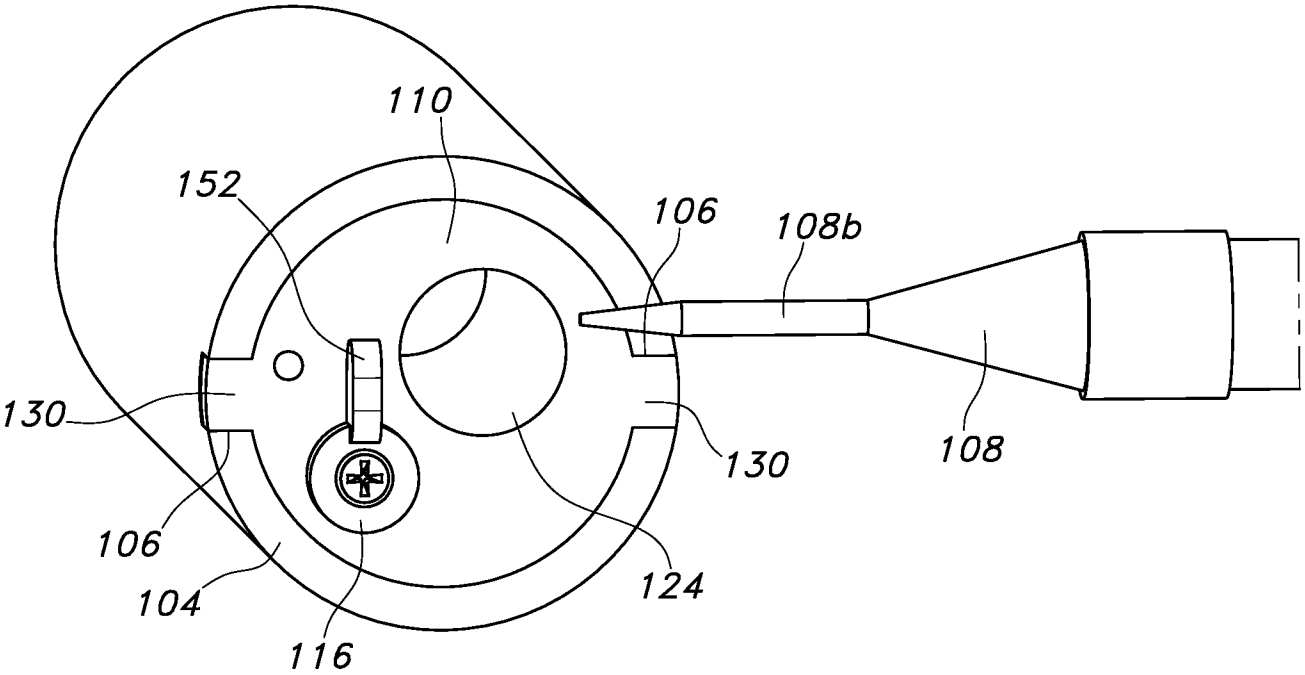
FIG. 13 is an isometric view showing the firing device for shock tube depicted in FIG. 1 inserted into a cobb, and a center punch.
Figure 14:
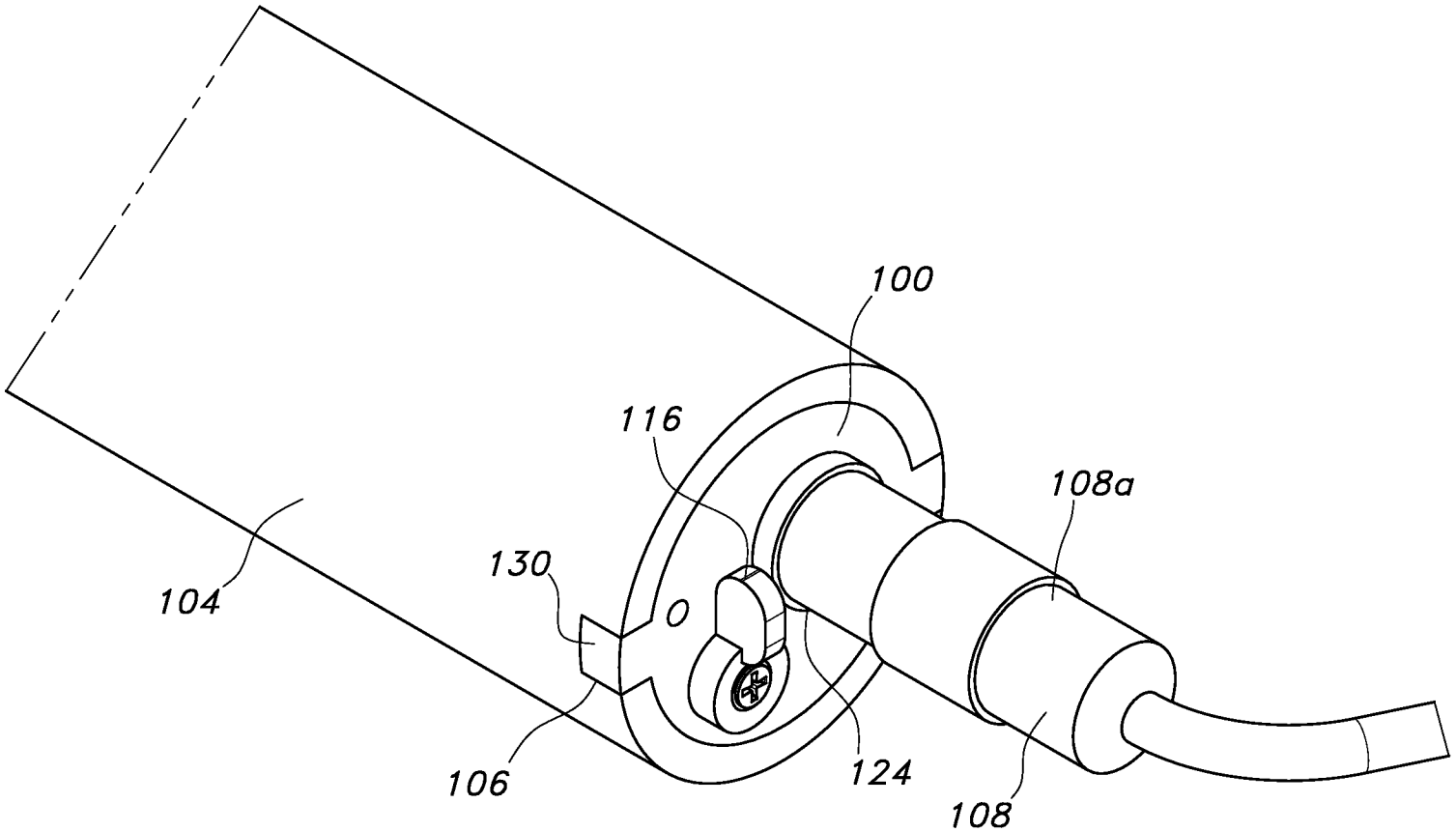
FIG. 14 is another isometric view of the firing device for shock tube shown in FIG. 13, wherein the center punch is inserted in the punch guide opening of the firing device.
Figure 15:
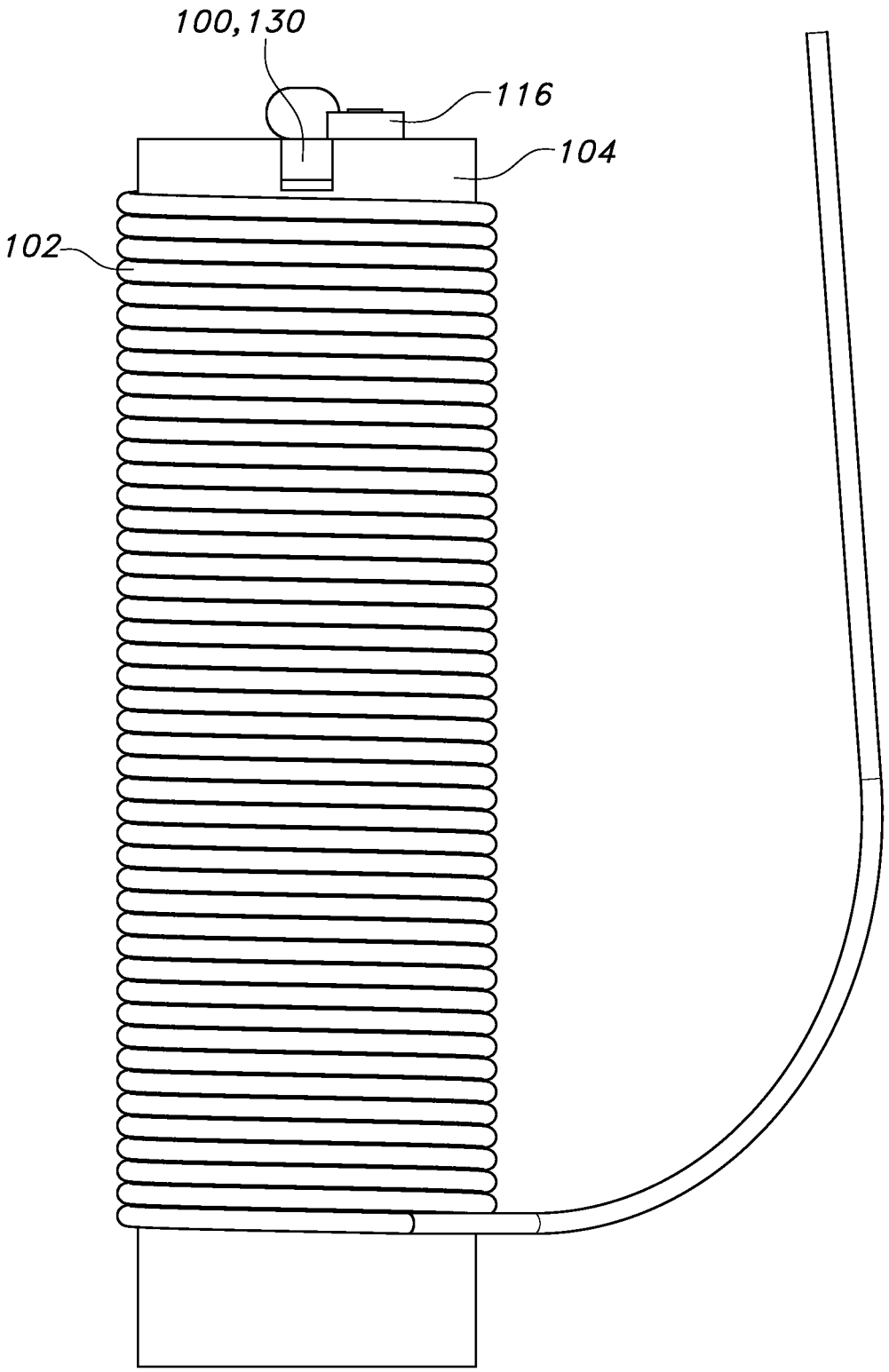
FIG. 15 is a side elevational view of the firing device for shock tube shown in FIG. 13, wherein a length of shock tube connected to the firing device is shown wrapped about the exterior of the cobb.

As shown best in FIGS. 6-9, the body 110 of the firing device 100 comprises a punch guide opening 124 for a center punch 108, and a selector shaft bore 126 for a cylindrical selector shaft 128 operably connecting the selector 116 and the primer tray 114. The punch guide opening 124 and the selector shaft bore 126 extend between a front end and a back end of the body 110. A front section of the punch guide opening 124 defines a punch aperture 174 configured (i.e., sized) so that only the tip 108*b* of the center punch 108 can extend therethrough. In this way, the tip of the spring-loaded punch 180*b* is able to make contact with, and thereby detonate, a primer aligned with the punch aperture 174 by the primer tray 114. The punch aperture 174 extends into an arcuate groove 176 on the front end of the body 110. The body 110 includes two indexing tabs 130 located adjacent the back end of the body 110. Each indexing tab 130 extends radially outward from the body 110. As shown in FIGS. 13-15, the indexing tabs 130 are configured to register with slots 106 in an end of a cobb 104, thereby preventing the firing device 100 from twisting or falling through the cobb 104. A cobb 104, known to those of ordinary skill in the art, is used to transport a firing device 100, a blasting cap (not shown), and the shock tube 102 connecting the firing device 100 to the blasting cap.

Figure 3:
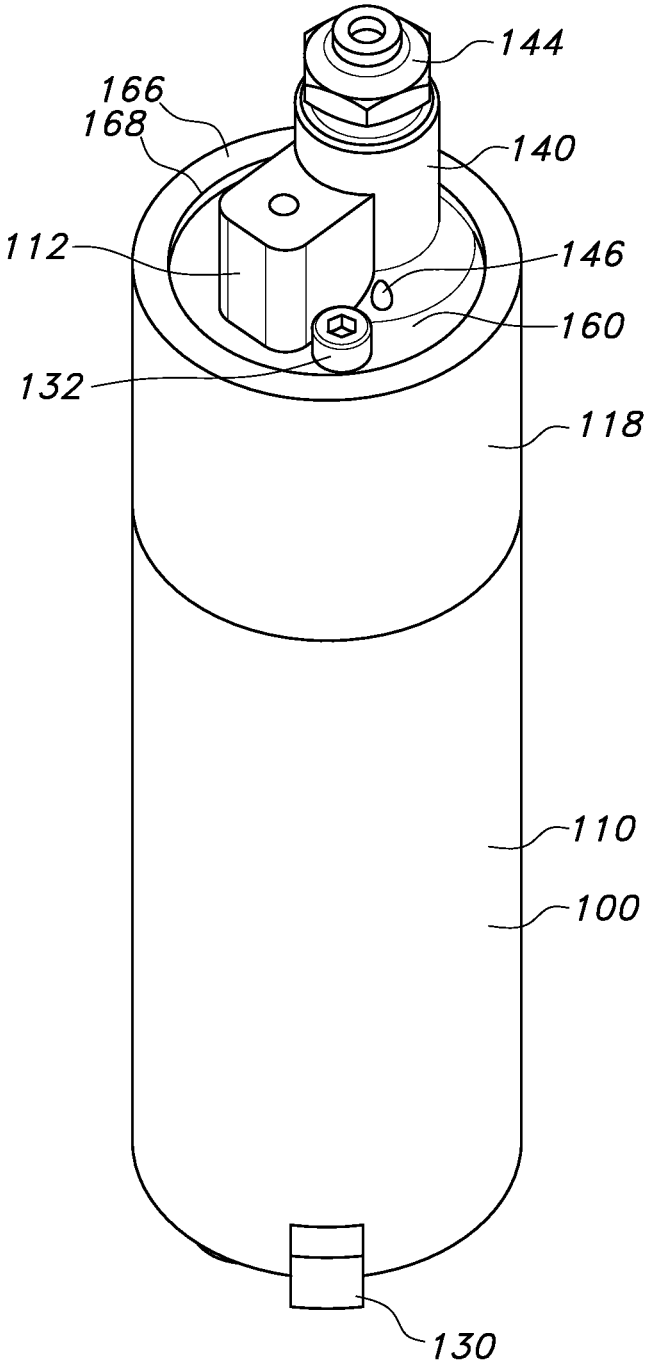
FIG. 3 is a top isometric view of the firing device for shock tube shown in FIG. 1.
Figure 4:
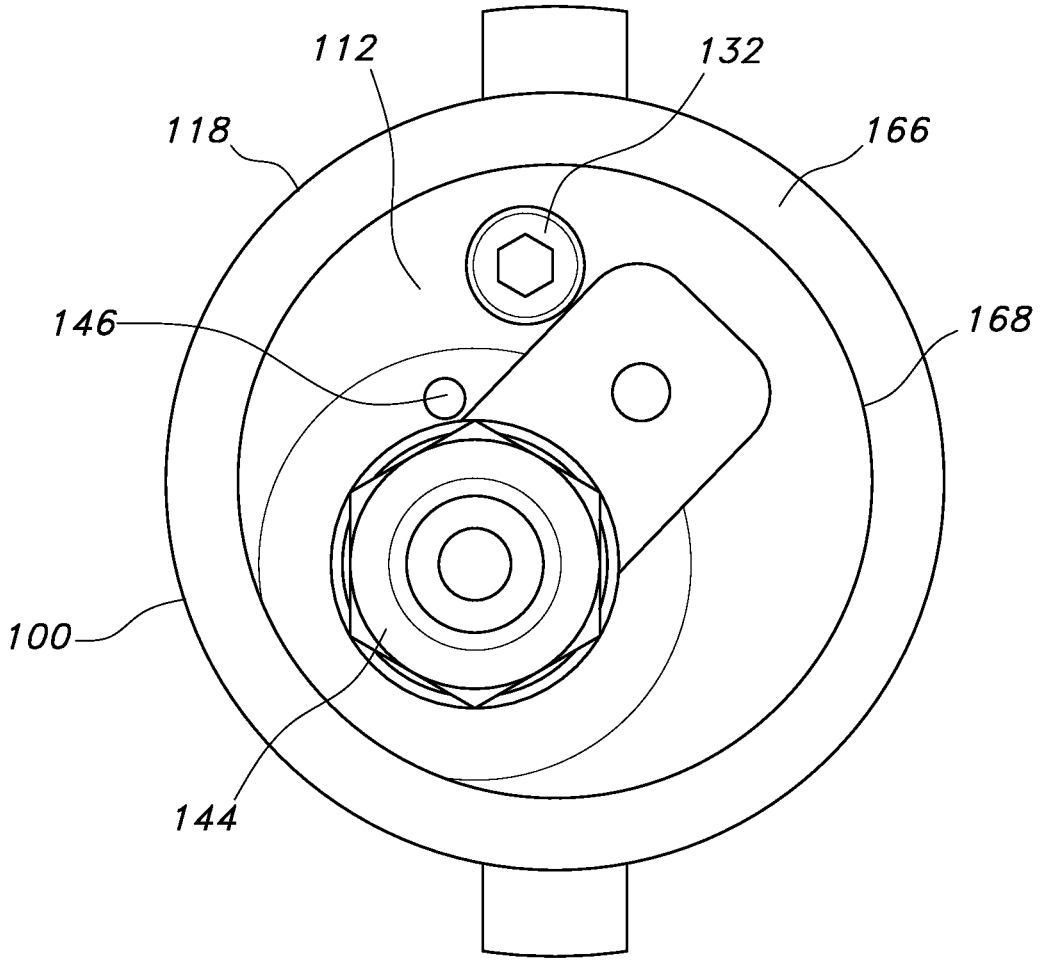
FIG. 4 is a top plan view of the firing device for shock tube shown in FIG. 1.
Figure 5:
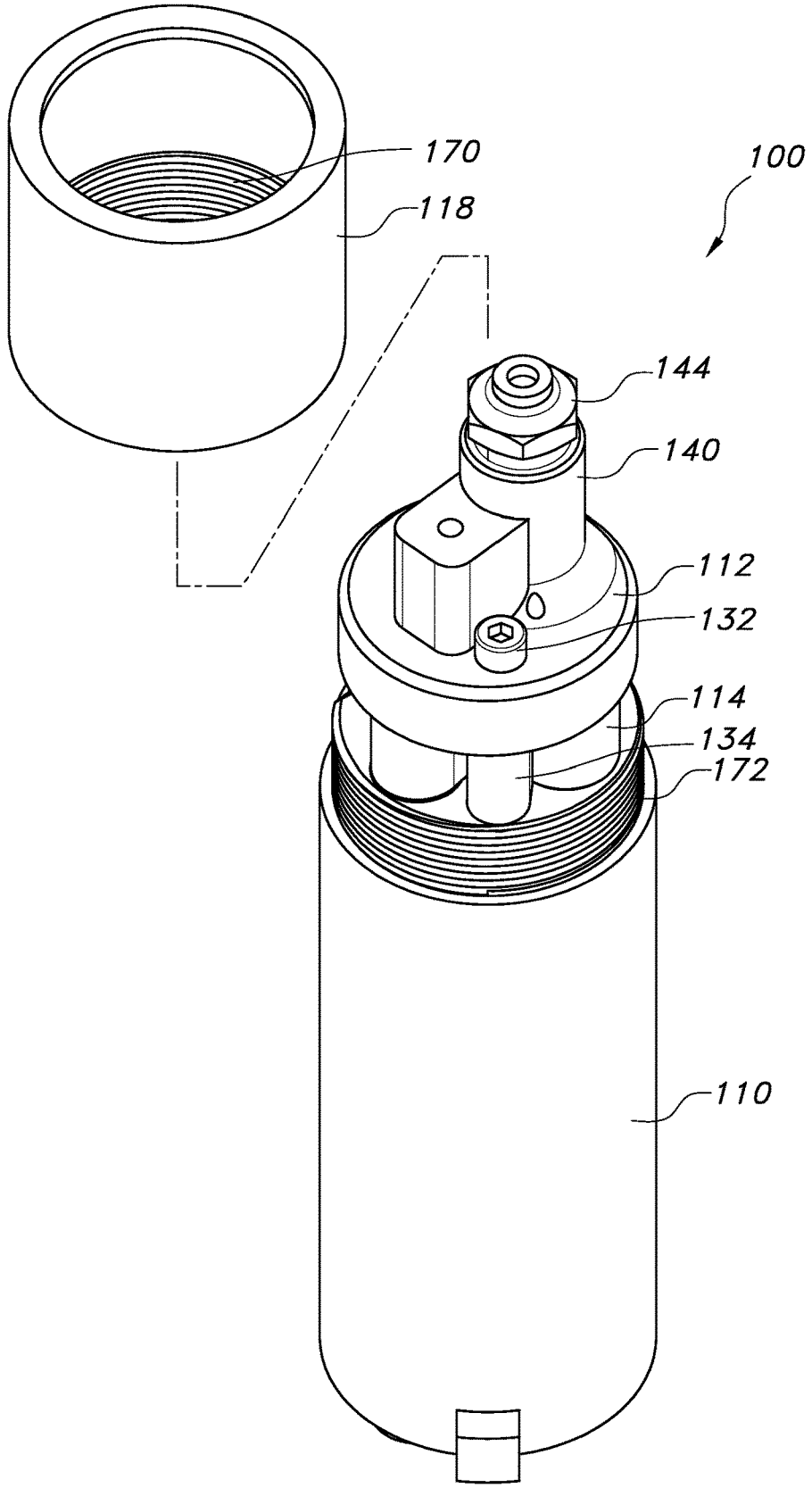
FIG. 5 is a top isometric view showing the debris shield exploded from the firing device for shock tube depicted in FIG. 1.

As shown best in FIGS. 3-5, the shock tube adapter 112 of the firing device 100 is made of a nonferrous metal (e.g., brass) and secured to one end of the body 110 by a threaded fastener 132. The shock tube adapter 112 includes a leg 134 used to offset it from the front end of the body 110. A portion of the leg 134 is configured to interface with (i.e., fit within) a cutout 136 in the front end of the body 110 (see, e.g., FIGS. 5 and 6). The threaded fastener 132 extends through the leg 134 of the shock tube adapter 112 and is threadedly received within a threaded opening 138 in the cutout 136 of the body 110. The cutout 136 is configured to mechanically prevent rotation of the shock tube adapter 112 relative to the body 110 of the firing device 100. The shock tube adapter 112 also includes a nozzle 140 that has a threaded opening 142 in a distal end thereof. The threaded opening 142 is configured to receive an instant fit connector 144, well known to those of ordinary skill in the art. The instant fit connector 144 is configured to connect the firing device 100 to an end of shock tube 102 (see, e.g., FIG. 16). Specifically, one end of shock tube 102 is inserted into the instant fit connector 144. In this way, the shock tube 102 is secured to the firing device 100 and placed into communication with the flash channel 122 of the shock tube adapter 112. For the purpose of clarity, it should be understood that the flash channel 122 extends into the threaded opening 142 of the nozzle 140 (see, e.g., FIG. 7). In some implementations, the flash channel 122 is also in fluid communication with at least one pressure vent 146 extending through the shock tube adapter 112. The pressure vent 146 is a tubular aperture and configured to release pressure resulting from the detonation of a primer (see, e.g., FIG. 3). Accordingly, the pressure vent 146 may prevent the shock tube 102 from detaching and/or melting during ignition.

Figure 6:
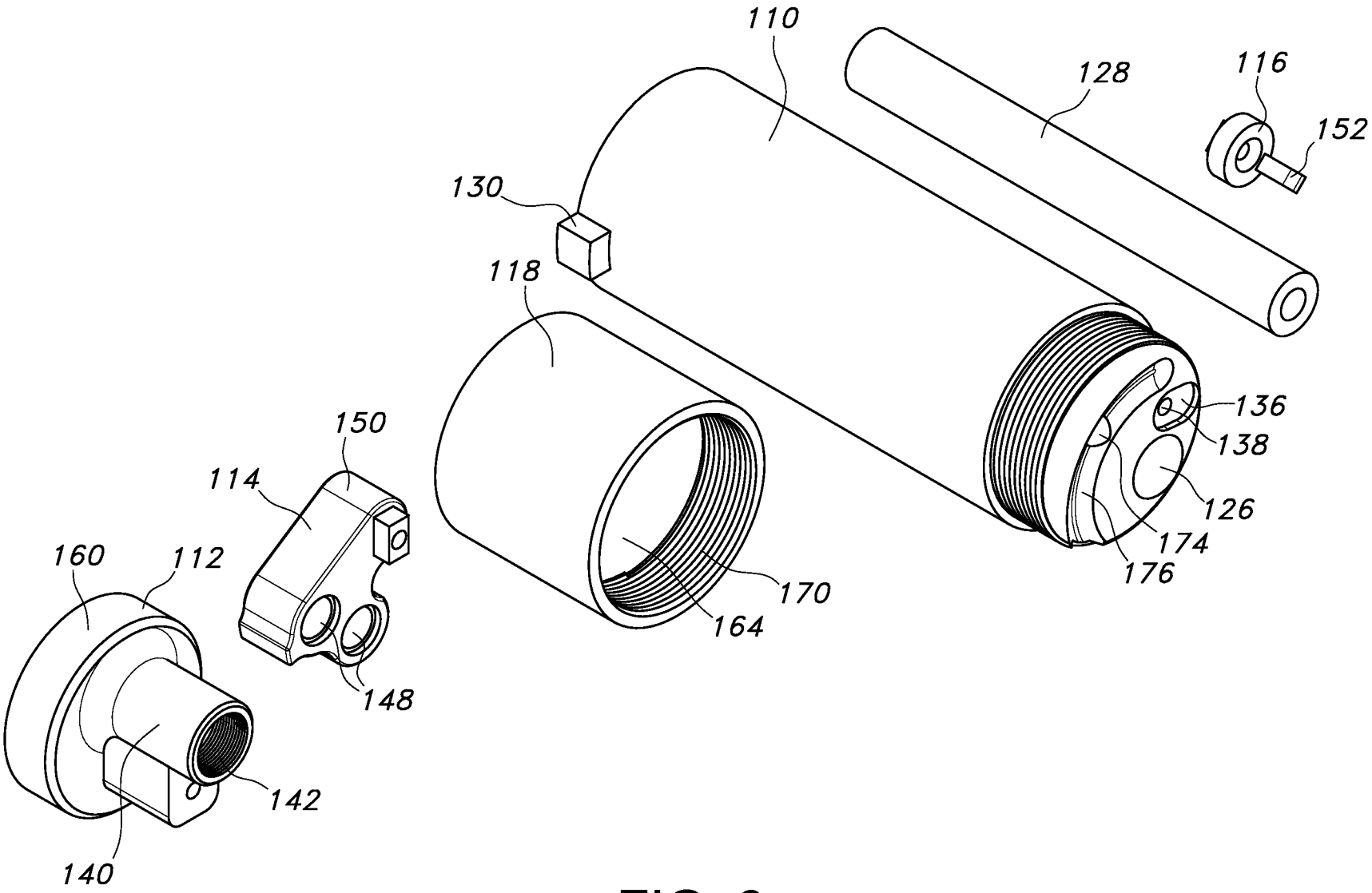
FIG. 6 is an exploded front isometric view showing the components of the firing device for shock tube depicted in FIG. 1, wherein fasteners are not illustrated for the sake of clarity.
Figure 7:
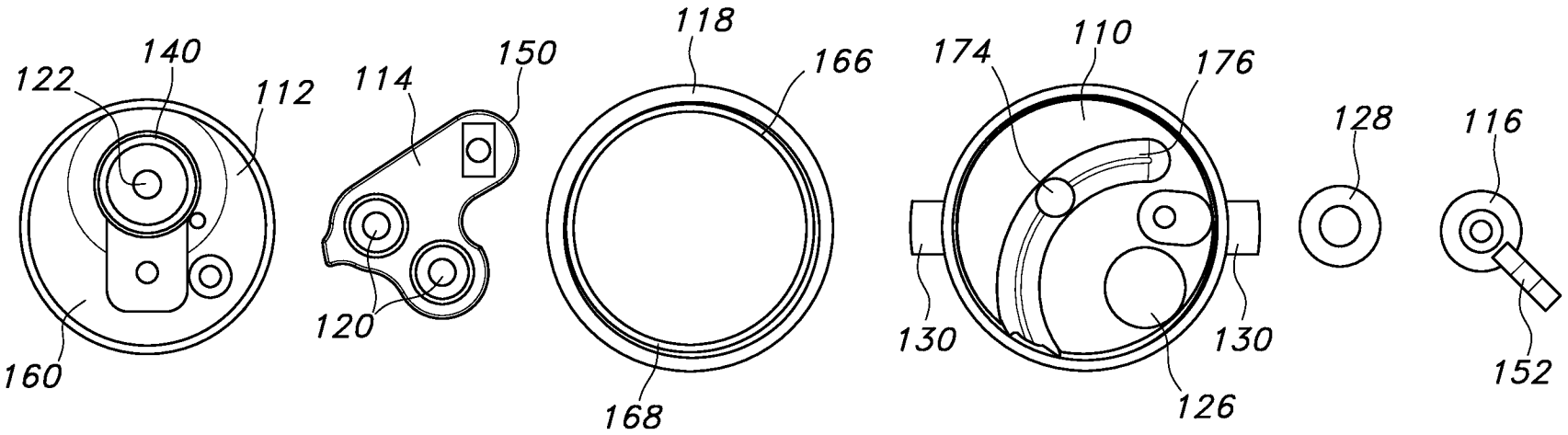
FIG. 7 is a front elevational view showing the components depicted in FIG. 6.
Figure 8:
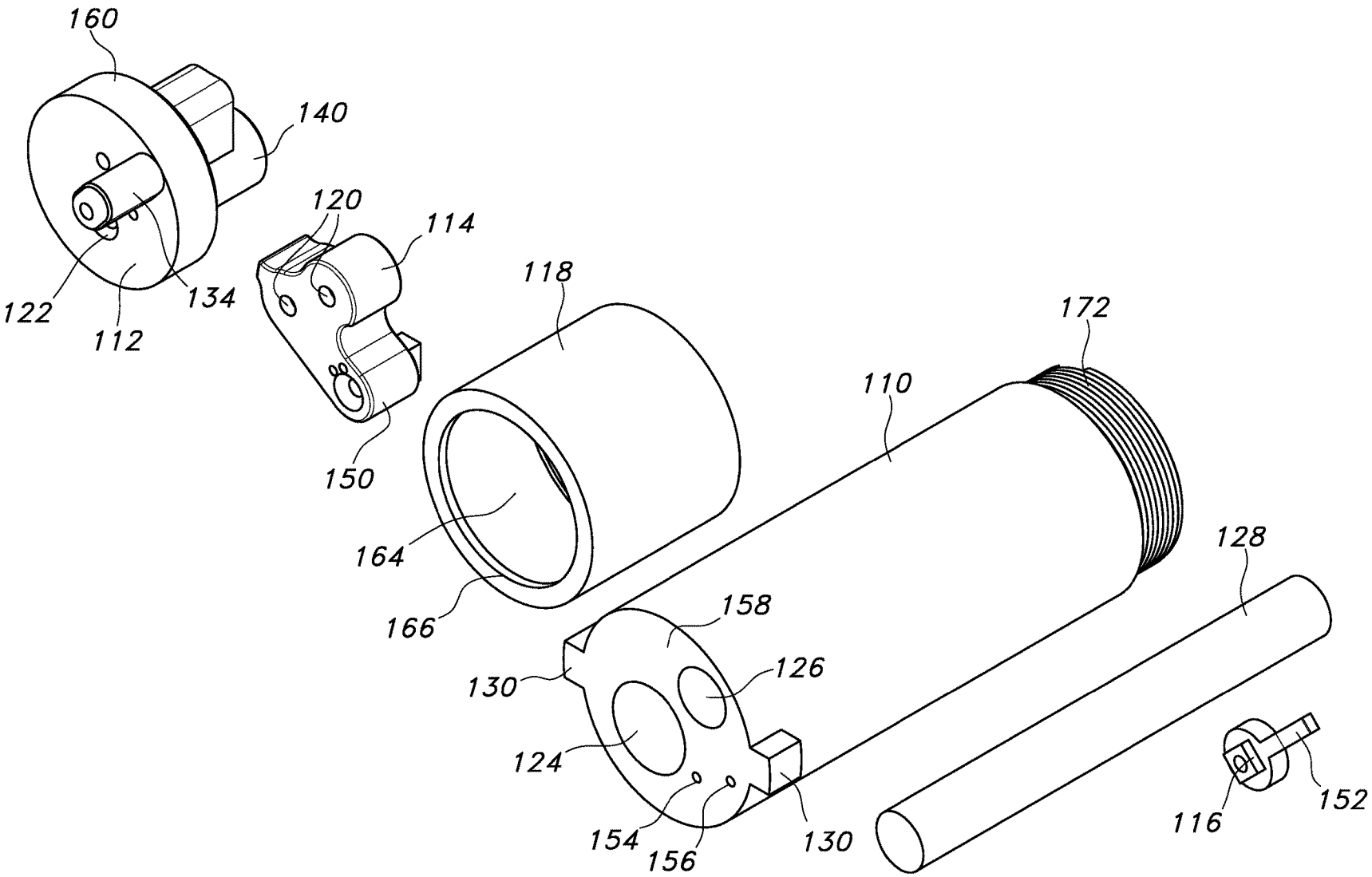
FIG. 8 is an exploded rear isometric view showing the components depicted in FIG. 6.
Figure 9:
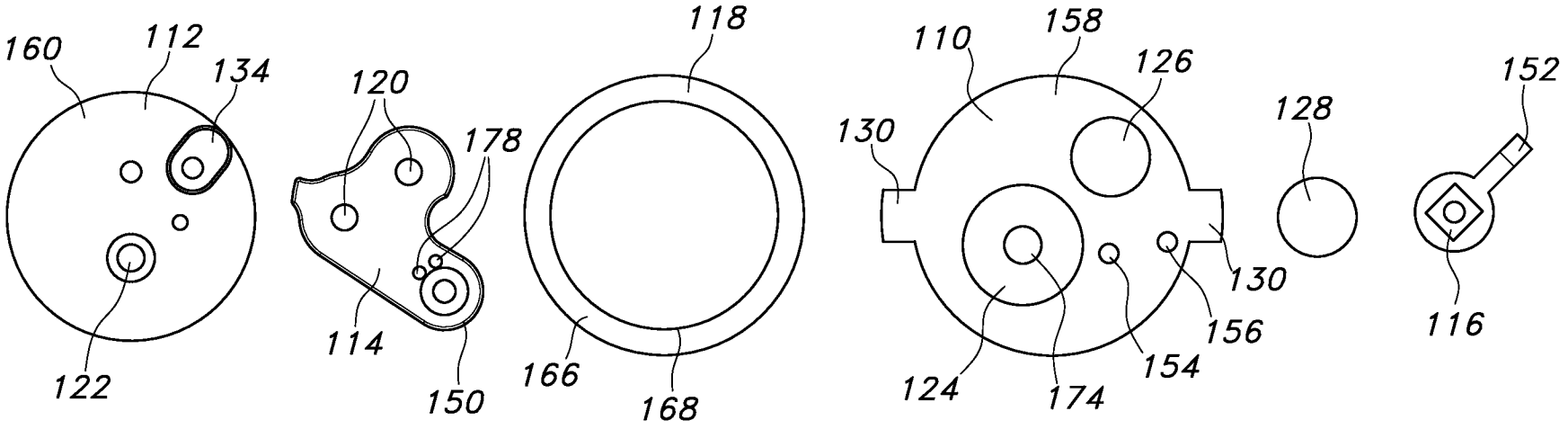
FIG. 9 is a rear elevational view showing the components depicted in FIG. 6.

The primer tray 114 is configured to pivot between a first use position, a second use position, and, when the debris sleeve 118 is removed, a tray service position. As shown in FIGS. 7 and 9, the primer tray 114 includes two continuous apertures 120 that extend through the primer tray 114. As shown in FIG. 6, one end of each aperture 120 includes a primer pocket 148 configured (i.e., sized) to receive a primer. The primer pocket 148 may retain the primer therein via compression fit. Placing the primer tray 114 in either the first use position or the second use position aligns one of the apertures 120 with both the punch aperture 174 of the punch guide channel 124 and the flash channel 122 leading to the shock tube 102 attached to the instant fit connector 144 on the shock tube adapter 112. The primer tray 114 also includes a pivot portion 150 that is operably connected to the selector 116 by the cylindrical selector shaft 128 extending through the body 110 of the firing device 100. The pivot portion 150 of the primer tray 114 may include two detent recesses 178. Each detent recess 178 is configured to partially receive a spring-loaded ball detent (not shown) located in the shock tube adapter 112. Each detent recess 178 comprises a depression or hole formed in the pivot portion 150 of the primer tray 114 (see, e.g., FIG. 9). The spring-loaded ball detent, in conjunction with the detent recesses 178, is configured to temporarily fix the primer tray 114 in either the first use position or the second use position, and to provide tactile resistance to any rotational movement of the primer tray 114.

Figure 1:
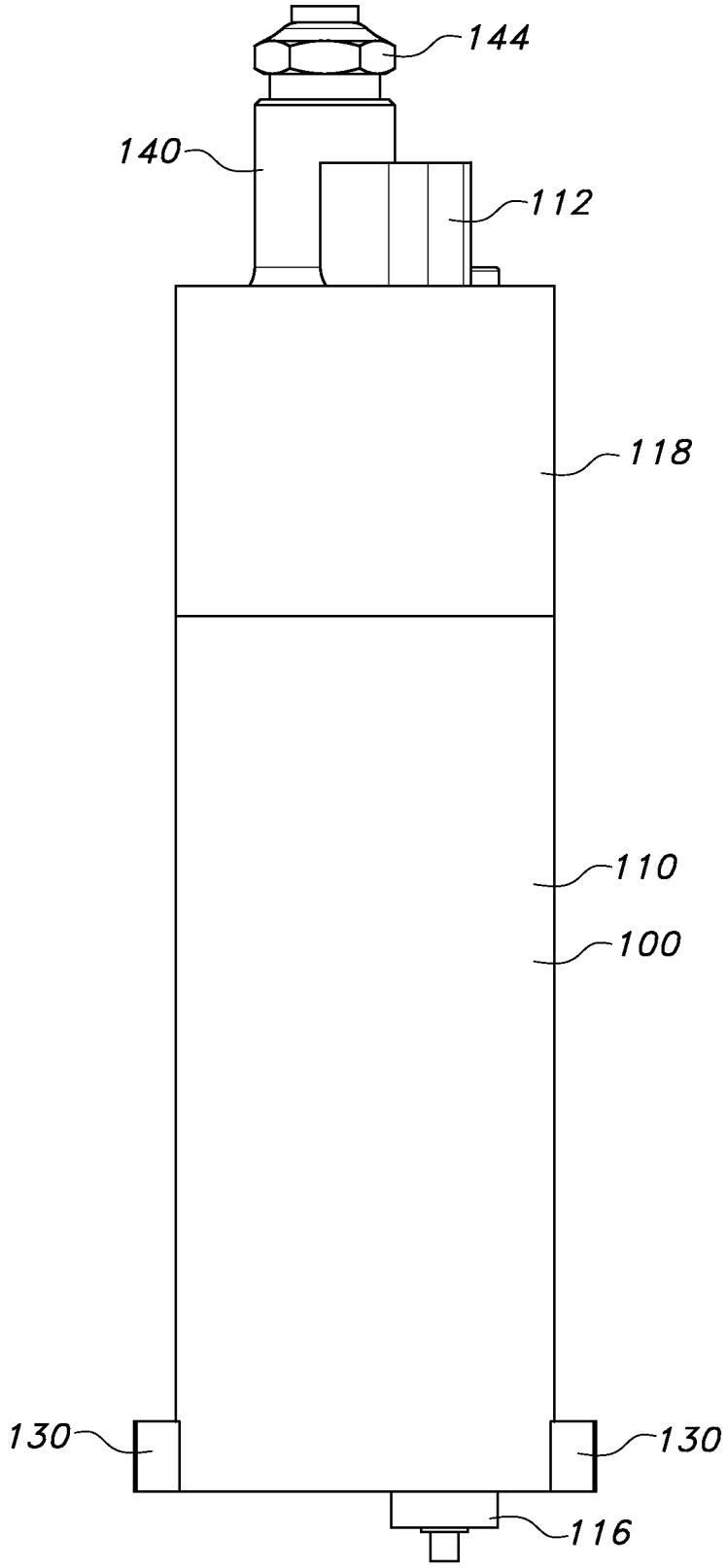
FIG. 1 is a side elevational view of a firing device for shock tube according to the principles of the present disclosure.
Figure 2:
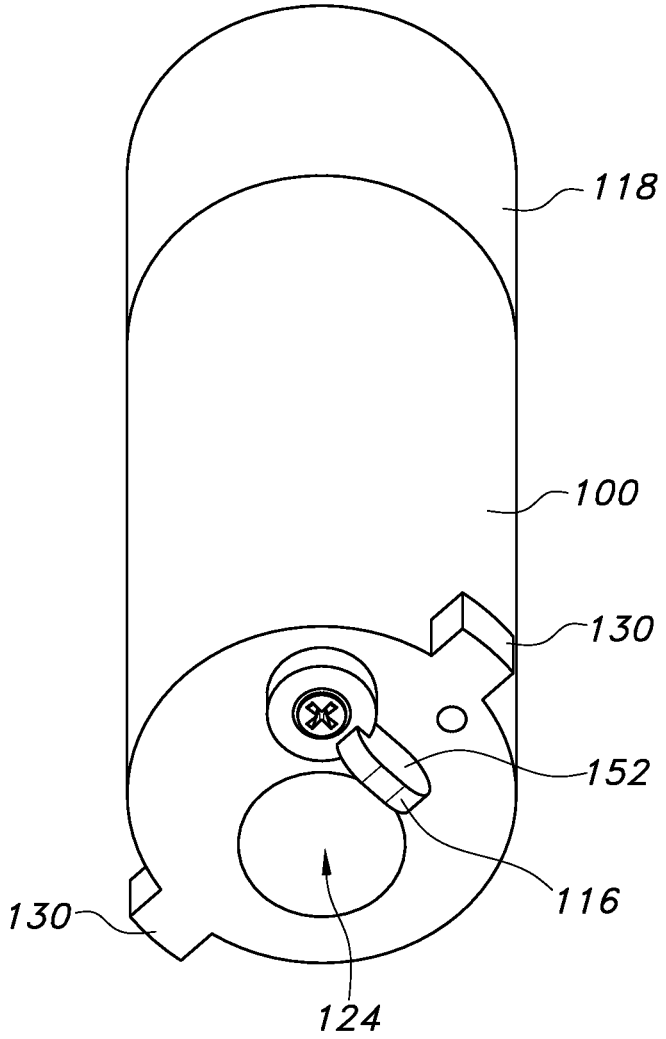
FIG. 2 is a bottom isometric view of the firing device for shock tube shown in FIG. 1.

As shown best in FIG. 1, the selector 116 is located on an end of the body 110, opposite the shock tube adapter 112. The selector 116 comprises a switch handle 152, having an elongated tab shape, that extends from the selector pivot axis (see, e.g., FIG. 2). The back end of the body 110 includes position indicia 154, 156 for the selector 116 that correlate to the use position of the primer tray 114 (see, e.g., FIG. 8). The selector 116 is operably connected to the primer tray 114 by the cylindrical selector shaft 128 extending through the longitudinally extending bore 126 in the body 110 of the firing device 100. The selector 116 and primer tray 114 are secured to opposite ends of the cylindrical selector shaft 128 by a threaded fastener.

As shown best in FIGS. 3-5, the debris sleeve 118 is configured for attachment to the end of the body 110 having the shock tube adapter 112, and to enclose the primer tray 114 and the cylindrical body 160 and leg 134 of the shock tube adapter 112. In this way, the primer tray 114 and flash channel 122 are protected from environmental debris that could cause a misfire, or otherwise inhibit detonation of a primer or ignition of the shock tube 102. As shown best in FIGS. 6-9, the debris sleeve 118 comprises a debris sleeve body 162 with an inner surface defining a hollow sleeve channel 164. One end of the cylindrical sleeve body 162 includes an annular lip 166 that defines an opening 168 through which a portion of the shock tube adapter 112 extends. The other end of the cylindrical sleeve body 162 includes interior threads 170 configured to threadedly engage with a threaded portion 172 of the body 110 located adjacent a front end of the body 110.

Operation and Use

Figure 10:
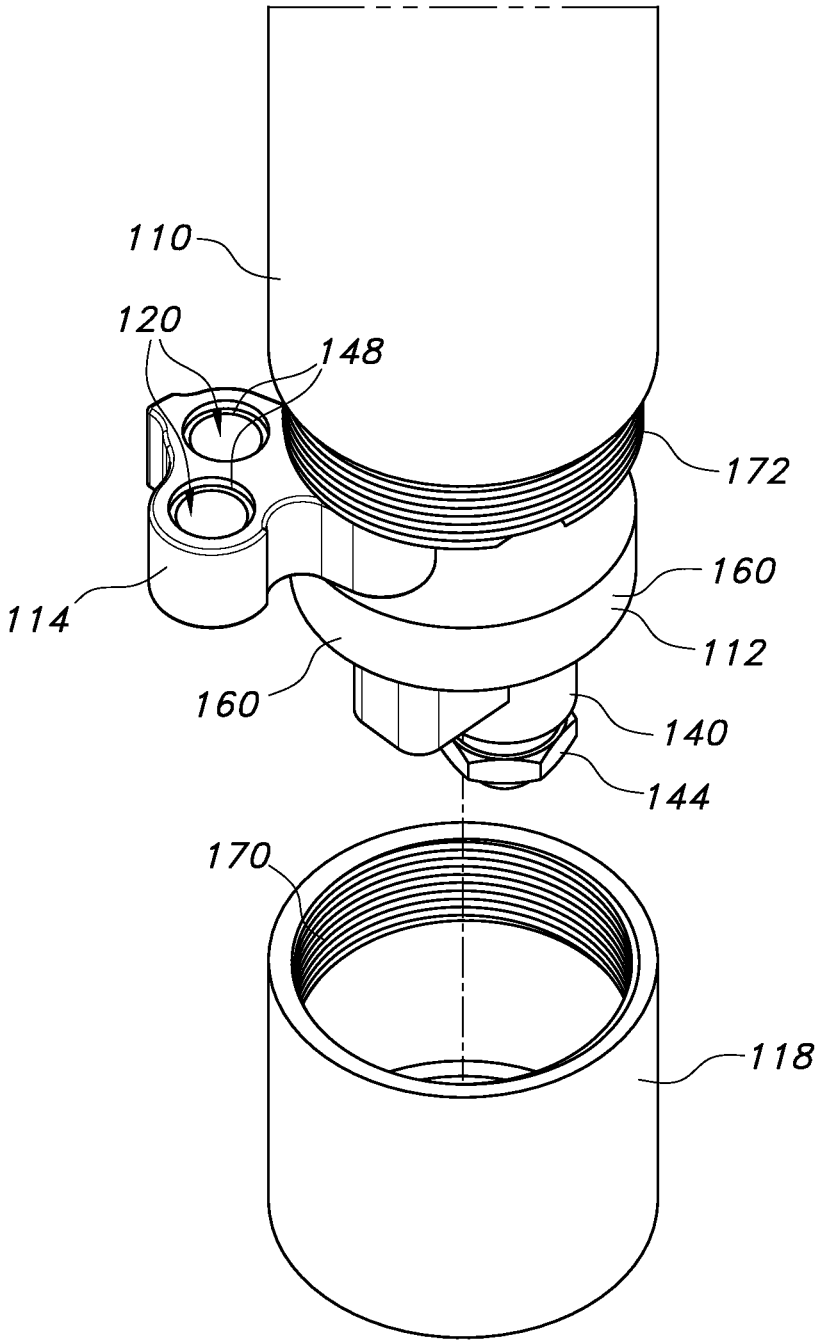
FIG. 10 is another isometric view showing the debris shield exploded from the firing device for shock tube depicted in FIG. 1, wherein the primer tray is rotated to the tray service position.
Figure 11:
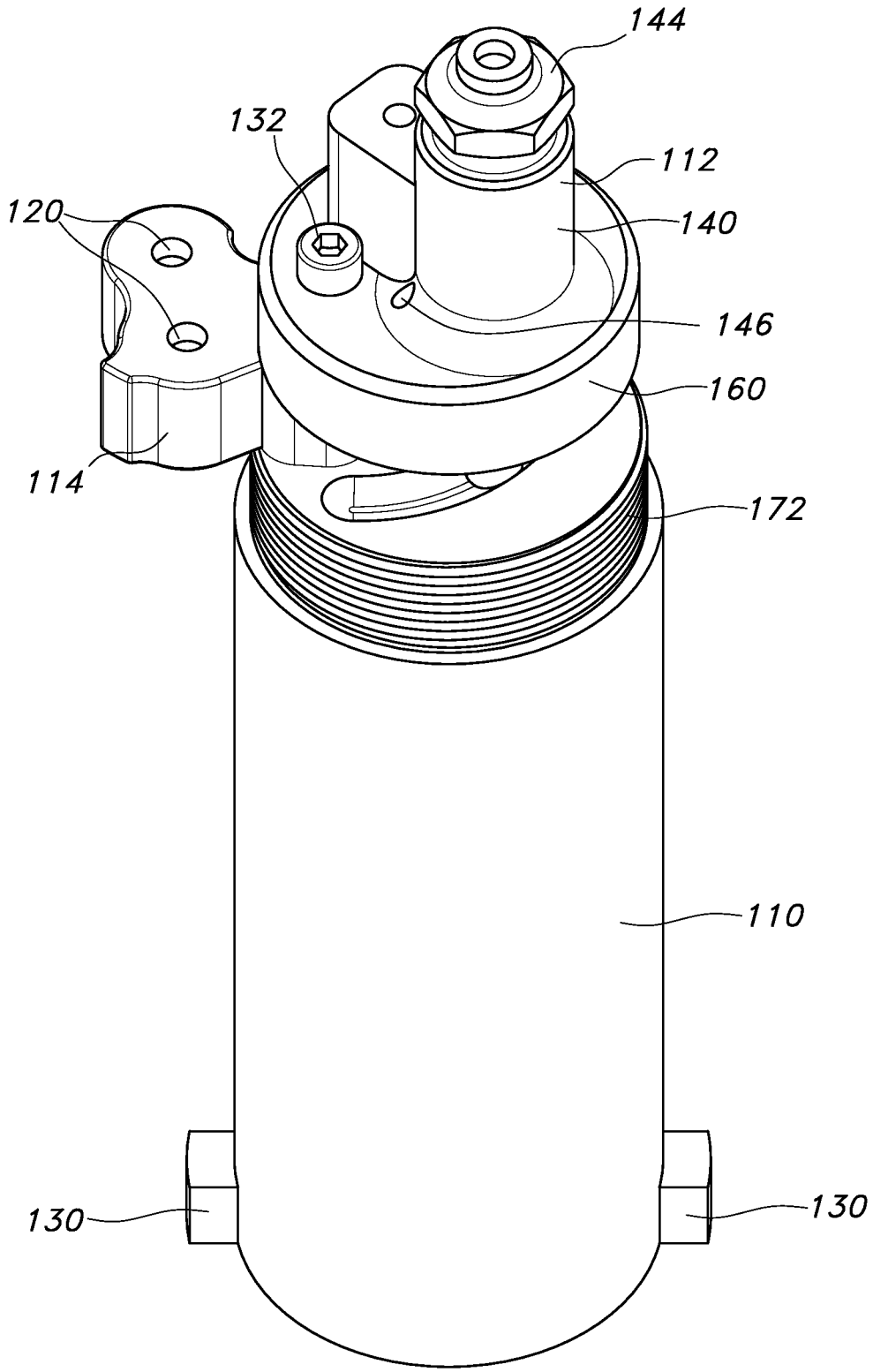
FIG. 11 is an isometric view of the firing device for shock tube shown in FIG. 1, wherein the debris shield has been removed and the primer tray rotated to the tray service position.
Figure 12:
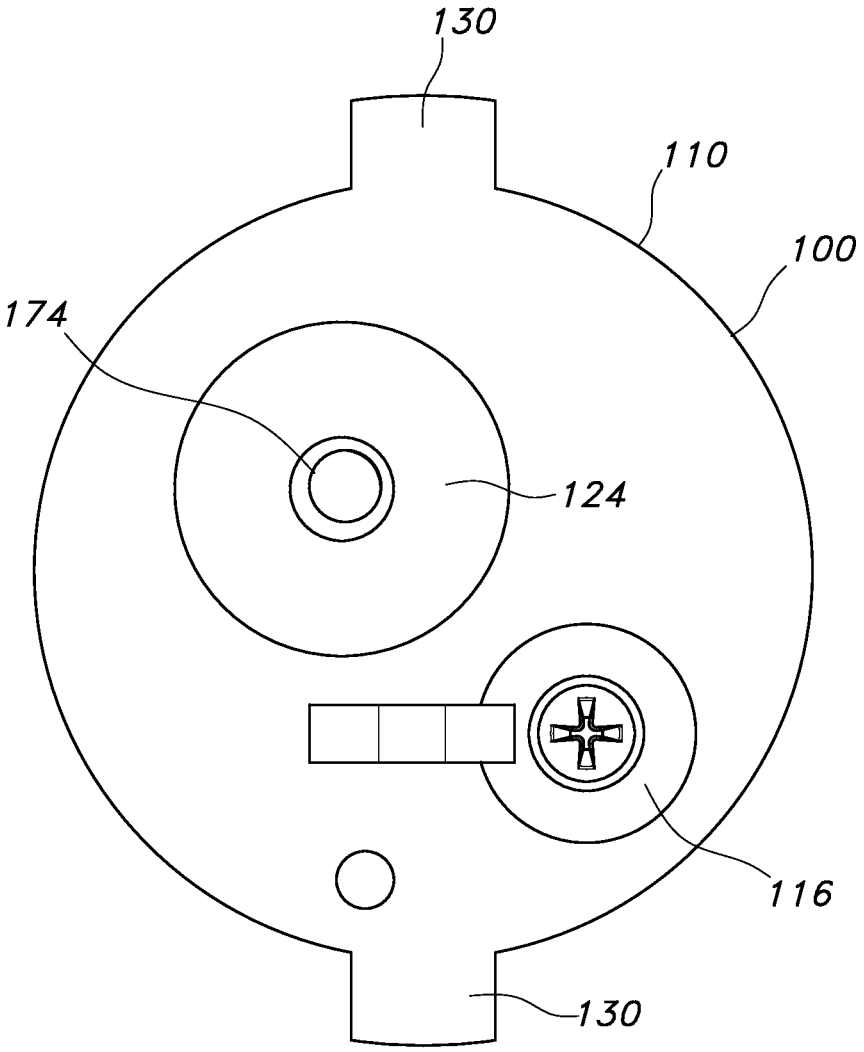
FIG. 12 is a bottom plan view of the firing device for shock tube shown in FIG. 1.

The primer tray 114 of the firing device 100 can be loaded using the following steps. Initially, remove the debris sleeve 118 from the body 110 of the firing device 100 (see, e.g., FIG. 5). Then, using the selector 116, rotate the primer tray 114 to the "tray service position" (see, e.g., FIG. 10). Next, after removing any spent primers, place a fresh primer in each primer pocket 148 of the primer tray 114. Then, using the selector 116, rotate the primer tray 114 to the first use position (see, e.g., FIG. 12). In addition to aligning the first primer aperture 120 with the punch aperture 174 of the punch guide channel 124 and the flash channel 122 of the shock tube adapter 112, the primer tray 114 is now positioned between the underside of the shock tube adapter 112 and the front end of the body 110 (see, e.g., FIG. 5). Next, screw the debris sleeve 118 onto the body 110 of the firing device 100 and thereby enclose the primer tray 114 (see, e.g., FIG. 3).

Once the primer tray 114 is loaded, the firing device 100 can be used to ignite the attached shock tube 102 using the following steps. Initially, insert a center punch 108 into the punch guide channel 124 in the body 110 of the firing device 100. Then, strike the rear of the center punch handle 108*a*, thereby causing the tip of the spring-loaded punch 108*b* to strike the primer. In this way, the primer is detonated. In the event of a misfire, rotate the primer tray 114 to the second use position (see, e.g., FIG. 13). Then, strike the rear of the center punch handle 108*a* again, thereby causing the tip of the spring-loaded punch 108*b* to strike the primer. In this way, the second primer carried by the primer tray 114 is detonated.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A firing device for shock tube comprising:
a body having a shock tube adapter on one end;
a primer tray configured to hold two primers; and
a selector operably connected to the primer tray;
wherein:
the shock tube adapter is configured to connect one end of shock tube to the firing device;
the primer tray defines two primer apertures and can be rotated between two use positions, each use position aligns one of the two primer apertures with an interior tubular aperture extending through the shock tube adapter.

2. The firing device of claim 1, wherein the body includes a punch guide opening that extends between a first end and a second end of the body, the punch guide opening defines a punch aperture that extends through the first end of the body and is aligned with the interior tubular aperture extending through the shock tube adapter.

3. The firing device of claim 1, wherein the shock tube adapter is made of a nonferrous metal and includes a leg used to offset the shock tube adapter from the body.

4. The firing device of claim 3, wherein the shock tube adapter also includes a nozzle through which the interior tubular aperture extends, a distal end of the nozzle includes a threaded opening configured to receive an instant fit connector used to connect shock tube to the shock tube adapter.

5. The firing device of claim 4, wherein the shock tube adapter includes a pressure vent configured to release pressure resulting from detonation of a primer, the pressure vent is a tubular aperture in fluid communication with the interior tubular aperture.

6. The firing device of claim 1, wherein the primer tray is positioned between the body and the shock tube adapter when the primer tray is in either of the two use positions.

7. The firing device of claim 1, wherein the selector is positioned on one end of the body opposite the shock tube adapter, the selector is operably connected to the primer tray by a cylindrical shaft extending through a longitudinally extending bore in the body.

8. The firing device of claim 1, further comprising a debris shield configured for attachment to one end of the body and to enclose the primer tray and a portion of the shock tube adapter.

9. The firing device of claim 8, the debris shield comprises a cylindrical sleeve having an annular lip on one end that defines an opening through which a portion of the shock tube adapter extends.

10. A firing device for shock tube comprising:
a body having a first end and a second end;
a shock tube adapter attached to the first end of the body;
a primer tray configured to hold two primers;
a selector operably connected to the primer tray; and
a debris shield removably attached to the first end of the body;
wherein:
the shock tube adapter is configured to connect one end of shock tube to the firing device;
the primer tray defines two primer apertures and can be rotated between two use positions, each use position aligns one of the two primer apertures with an interior tubular aperture extending through the shock tube adapter;

the debris shield is configured to enclose the primer tray and a portion of the shock tube adapter.

11. The firing device of claim 10, wherein the body includes a punch guide opening that extends between the first end and the second end of the body, the punch guide opening defines a punch aperture that extends through the first end of the body and is aligned with the interior tubular aperture extending through the shock tube adapter.

12. The firing device of claim 10, wherein the shock tube adapter is made of a nonferrous metal and includes a leg used to offset the shock tube adapter from the first end of the body.

13. The firing device of claim 12, wherein the shock tube adapter also includes a nozzle through which the interior tubular aperture extends, a distal end of the nozzle includes a threaded opening configured to receive an instant fit connector used to connect shock tube to the shock tube adapter.

14. The firing device of claim 13, wherein the shock tube adapter includes a pressure vent configured to release pressure resulting from detonation of a primer, the pressure vent is a tubular aperture in fluid communication with the interior tubular aperture.

15. The firing device of claim 10, wherein the primer tray is positioned between the body and the shock tube adapter when the primer tray is in either of the two use positions.

16. The firing device of claim 10, wherein the selector is positioned on the second end of the body opposite the shock tube adapter, the selector is operably connected to the primer tray by a cylindrical shaft extending through a longitudinally extending bore in the body.

17. The firing device of claim 10, the debris shield comprises a cylindrical sleeve having an annular lip on one end that defines an opening through which a portion of the shock tube adapter extends.

* * * * *